US007049734B2

(12) United States Patent
Tamura

(10) Patent No.: US 7,049,734 B2
(45) Date of Patent: May 23, 2006

(54) STRUCTURE OF SPARK PLUG ACHIEVING HIGH DEGREE OF AIR-TIGHTNESS

(75) Inventor: Masayuki Tamura, Handa (JP)

(73) Assignee: Denso Corporation, Kariya (JP)

( * ) Notice: Subject to any disclaimer, the term of this patent is extended or adjusted under 35 U.S.C. 154(b) by 128 days.

(21) Appl. No.: 10/895,076

(22) Filed: Jul. 21, 2004

(65) Prior Publication Data

US 2005/0017622 A1 Jan. 27, 2005

(30) Foreign Application Priority Data

Jul. 22, 2003 (JP) ..... 2003-277587

(51) Int. Cl.
*H01T 13/20* (2006.01)

(52) U.S. Cl. ..... 313/143; 313/118; 313/141

(58) Field of Classification Search ..... 313/118, 313/135, 141, 143, 144
See application file for complete search history.

(56) References Cited

U.S. PATENT DOCUMENTS 5,508,582 A * 4/1996 Sugimoto et al. ..... 313/118
6,130,498 A 10/2000 Shimizu et al. ..... 313/141
6,335,587 B1 * 1/2002 Matsubara ..... 313/141
6,366,008 B1 * 4/2002 Fukushima et al. ..... 313/141
6,538,365 B1 * 3/2003 Nasu et al. ..... 313/118
6,548,945 B1 * 4/2003 Tamura ..... 313/141
6,731,052 B1 * 5/2004 Moriya ..... 313/141
6,741,015 B1 * 5/2004 Suzuki et al. ..... 313/143
2002/0067112 A1 6/2002 Suzuki et al. ..... 313/143

FOREIGN PATENT DOCUMENTS

JP 11-242982 9/1999
JP 2002-164147 6/2002

* cited by examiner

*Primary Examiner*—Joseph Williams
*Assistant Examiner*—Kevin Quarterman
(74) *Attorney, Agent, or Firm*—Nixon & Vanderhye P.C.

(57) ABSTRACT

A spark plug is provided which is constructed to ensure a higher degree of air-tightness. The spark plug includes a cylindrical metal housing within which an insulation porcelain is disposed. The housing has a hexagon head formed on an outer wall thereof and an annular chamber defined between itself and the insulation porcelain within which a sealing powder is disposed. The housing has an annular extension formed on the hexagon head. The annular extension is crimped inward to compress the sealing powder to enhance the air-tightness between the housing and the insulation porcelain. The annular extension has featured dimensions in order to ensure a desired degree of the air-tightness.

7 Claims, 4 Drawing Sheets

STRUCTURE OF SPARK PLUG ACHIEVING HIGH DEGREE OF AIR-TIGHTNESS

BACKGROUND OF THE INVENTION

1 Technical Field of the Invention

The present invention relates generally to an improved structure of a spark plug which may be used in internal combustion engines of automotive vehicles, cogeneration systems, or gas pumps, and more particularly to such a spark plug which achieves a higher degree of air-tightness.

2 Background Art

Spark plugs used in cogeneration engines are usually subjected to an increase in temperature of a seat of the spark plug (i.e., a gasket) due to the lack of cooling of the spark plug as compared with those used in automotive engines. The seat of the spark plugs is heated up to 200° C. to 300° C. Further, the cogeneration engines are usually higher in compressibility than the automotive engines, so that the spark plugs are exposed to compressed gas which will be higher in combustion pressure than that in the automotive engines.

Typical spark plugs have sealing powder filled in an annular chamber formed between a housing (i.e., a metal shell) and an insulation porcelain. The housing has an annular sleeve cold-crimped to compress the sealing powder to eliminate a clearance between the housing and the insulation porcelain in order to improve air-tightness therebetween. In some of the spark plugs, the annular sleeve is hot-crimped after cold-crimped in order to enhance the air-tightness further. For instance, Japanese Patent First Publication No. 11-242982 teaches such technique.

However, in recent years, the cogeneration engines have been required to improve the air-tightness of the spark plugs because of higher combustion pressure required for increasing the efficiency of burning of the engines.

SUMMARY OF THE INVENTION

It is therefore a principal object of the invention to provide a spark plug which is constructed to achieve a higher degree of air-tightness.

According to one aspect of the invention, there is provided a spark plug for an internal combustion engine which is designed to achieve a high degree of air-tightness. The spark plug comprises: (a) a ground electrode; (b) a center electrode defining a spark gap between itself and the ground electrode; (c) an insulation porcelain having the center electrode retained therein; (d) a cylindrical metal housing within which the insulation porcelain is disposed, the metal housing defining an annular chamber between an inner wall of the metal housing and an outer wall of the insulation porcelain; (e) a polygon portion formed on an outer wall of the metal housing around the annular chamber; (f) a powder layer filled within the annular chamber to establish a hermetic seal between the metal housing and the insulation porcelain; and (g) an annular extension formed on the metal housing which extends from an end of the polygon portion to have an open end opposite an end thereof continuing from the polygon portion. The open end is crimped inward of the metal housing to retain the powder layer within the annular chamber firmly. The open end having a thickness of 1.0 mm to 1.4 mm. We have found experimentally that such a thickness range ensures the degree of the crimping of the annular extension required to compress the powder layer firmly, which achieves a higher degree of air-tightness between the metal housing and the insulation porcelain.

In the preferred mode of the invention, the end of the annular extension interfacing the polygon portion formed on the metal housing has a thickness of 1.5 mm to 1.9 mm in a radius direction of the metal housing. We also have found experimentally that such a thickness range ensures the rigidity of the annular extension required to achieve a desired degree of the crimping of the annular extension, which establishes a higher degree of air-tightness between the metal housing and the insulation porcelain The spark plug may further include a ring which is disposed within the annular chamber in abutment with an inner wall of the annular extension. The metal housing has a length extending in a direction in which the polygon portion and the annular extension are aligned. If the center of gravity of a cross section of the ring, as taken in a lengthwise direction of the metal housing is defined as a ring gravity center G, a contact between the ring and the inner wall of the annular extension is defined as a ring-to-extension contact B, an intersection of a line extending through the ring gravity center G and the ring-to-extension contact B with the outer wall of the annular extension is defined as an extension intersection C, and a distance between the open end of the annular extension and the extension intersection C along the outer wall of the annular extension is defined as an extension top length N, the extension top length N lies preferably within a range of 1.5 mm to 2.5 mm. We also have found experimentally that such a length range ensures a desired degree of air-tightness between the metal housing and the insulation porcelain.

If a distance between the end of the annular extension interfacing the polygon portion and the extension intersection C along the outer wall of the annular extension is defined as an extension base length M, the extension base length M lies preferably within a range of 2.5 mm to 3.5 mm. We also have found experimentally that such a length range ensures a desired degree of air-tightness between the metal housing and the insulation porcelain.

The metal housing may have an external thread which establishes engagement with an internal thread formed in an internal combustion engine. The external thread has a metric screw size of M18 suitable for typical cogeneration engines.

The spark plug may be used in an internal combustion engine which is to be operated at an average effective pressure of 1 MPa or more.

According to the second aspect of the invention, there is provided a spark plug for an internal combustion engine which comprises: (a) a ground electrode; (b) a center electrode defining a spark gap between itself and the ground electrode; (c) an insulation porcelain having the center electrode retained therein; (d) a cylindrical metal housing within which the insulation porcelain is disposed, the metal housing defining an annular chamber between an inner wall of the metal housing and an outer wall of the insulation porcelain; (e) a polygon portion formed on an outer wall of the metal housing around the annular chamber; (f) a powder layer filled within the annular chamber to establish a hermetic seal between the metal housing and the insulation porcelain; (g) an annular extension formed on the metal housing which extends from an end of the polygon portion to have an open end opposite an end thereof continuing from the polygon portion, the open end being crimped inward of the metal housing to retain the powder layer within the annular chamber firmly; and (h) a ring disposed within the annular chamber in abutment with an inner wall of the annular extension. The metal housing has a length extending in a direction in which the polygon portion and the annular extension are aligned. The open end of the annular extension has a thickness of 1.0 mm to 1.4 mm. The end of the annular extension interfacing the polygon portion has a thickness of 1.5 mm to 1.9 mm in a radius direction of the metal housing. If the center of gravity of a cross section of the ring, as taken in a lengthwise direction of the metal housing is defined as a ring gravity center G, a contact between the ring and the inner wall of the annular extension is defined as a ring-to-extension contact B, an intersection of a line extending through the ring gravity center G and the ring-to-extension contact B with the outer wall of the annular extension is defined as an extension intersection C, a distance between the open end of the annular extension and the extension intersection C along the outer wall of the annular extension is defined as an extension top length N, and a distance between the end of the annular extension interfacing the polygon portion and the extension intersection C along the outer wall of the annular extension is defined as an extension base length M, the extension top length N lies within a range of 1.5 mm to 2.5 mm, and the extension base length M lies within a range of 2.5 mm to 3.5 mm.

We have found experimentally that when the open end thickness is less than 1.0 mm, it results in a lack of rigidity of the annular extension after pressed inward, thus causing the annular extension to be returned outward by the reaction of the powder layer, which will result in a lack of compression of the powder layer, while when the open end thickness is more than 1.4 mm, it results in an undesirable increase in rigidity of the annular extension, which increases a difficulty in crimping or deforming the annular extension into a desired shape in a direction in which the powder layer is compressed firmly.

We have also found that when the end of the annular extension interfacing the polygon portion is less than 1.5 mm, it results in a lack of rigidity of the annular extension after pressed inward, thus causing the annular extension to be returned outward by the reaction of the powder layer, which will result in a lack of compression of the powder layer, and when the end thickness is more than 1.9 mm, it results in an undesirable increase in rigidity of the annular extension, which increases a difficulty in crimping or deforming the annular extension into a desired shape in a direction in which the powder layer is compressed firmly.

We also have found the extension top length N is less than 1.5 mm, it results in a difficulty in wrapping the ring completely, thus resulting in a lack of compression of the powder layer, while when the extension top length N is more than 2.5 mm, it causes the annular extension to interfere physically with the insulation porcelain, thus resulting in a lack in compression of the powder layer.

We have also found that when the extension base length M is less than 2.5 mm, it results in an undesirable increase in rigidity of the annular extension, which increases a difficulty in crimping or deforming the annular extension into a desired shape in a direction in which the powder layer is compressed firmly, and when the extension based length M is more than 3.5 mm, it results in a lack of rigidity of the annular extension after pressed inward, thus causing the annular extension to be returned outward by the reaction of the powder layer, which will result in a lack of compression of the powder layer.

BRIEF DESPCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

Figure 1:
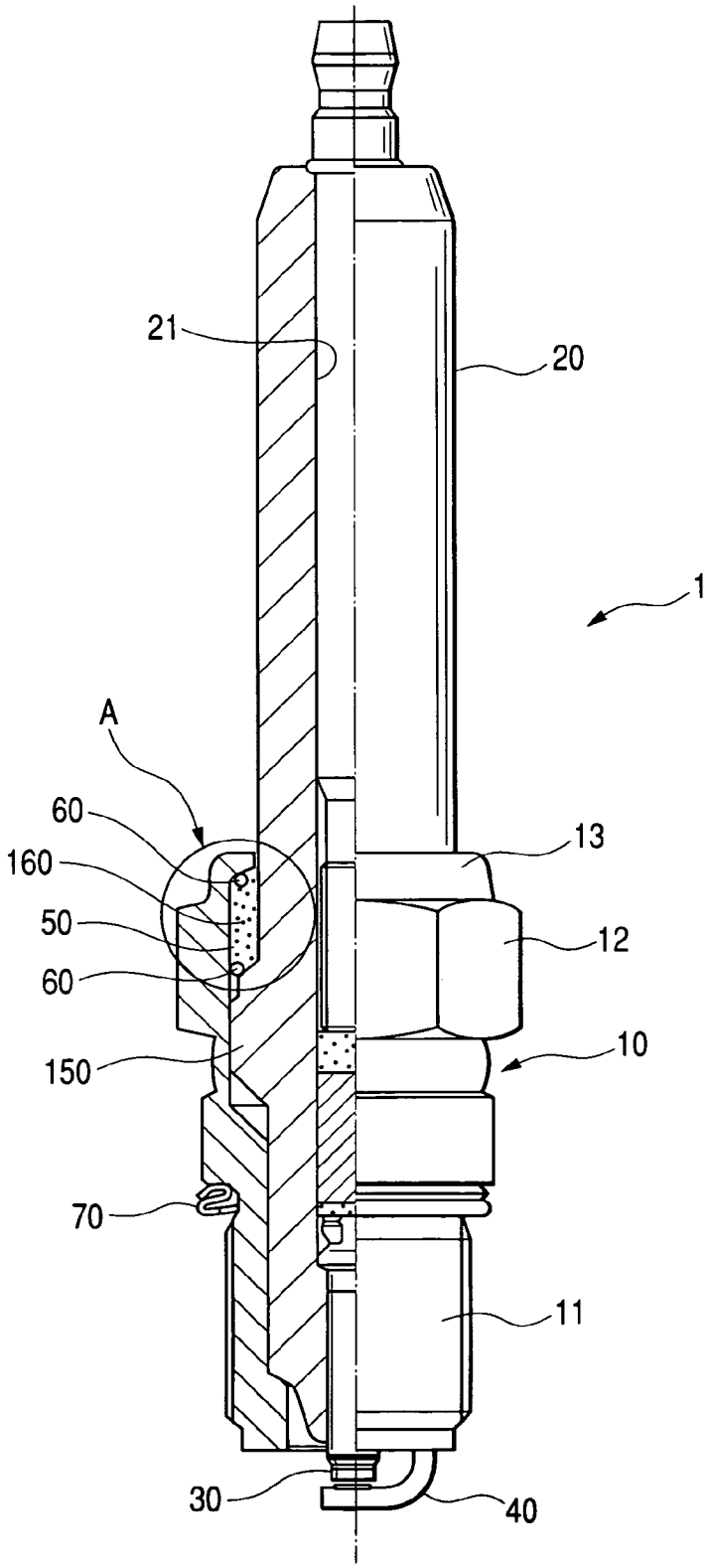
FIG. 1 is a partially sectional view which shows a spark plug according to the first embodiment of the invention.
Figure 3:
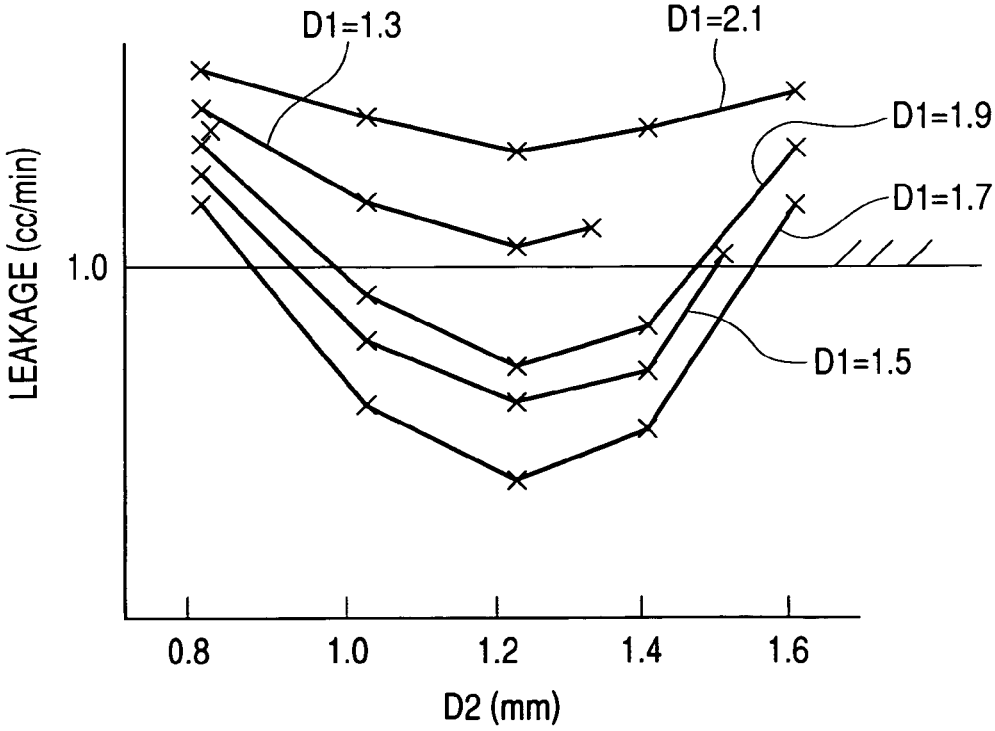
Figure 4:
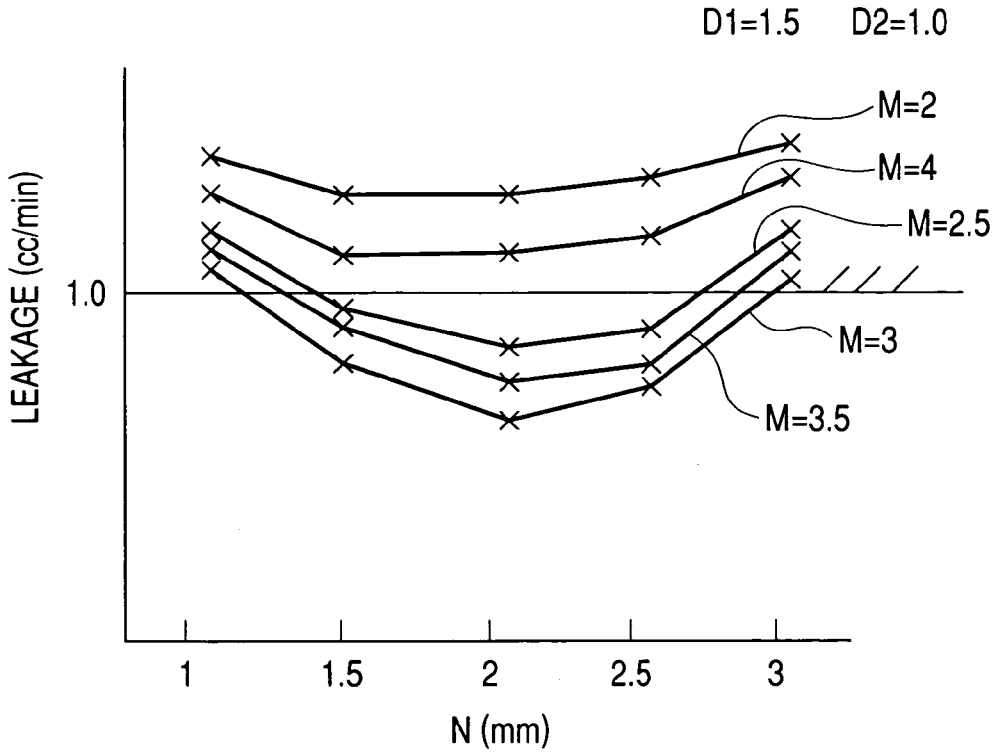
Figure 5:
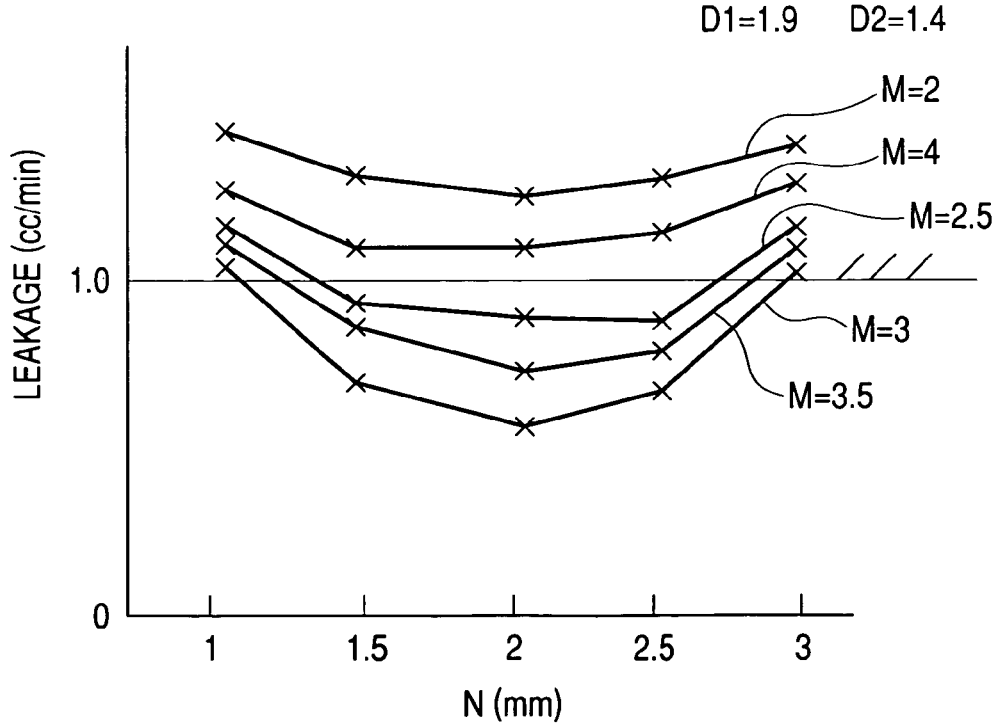
Figure 6:
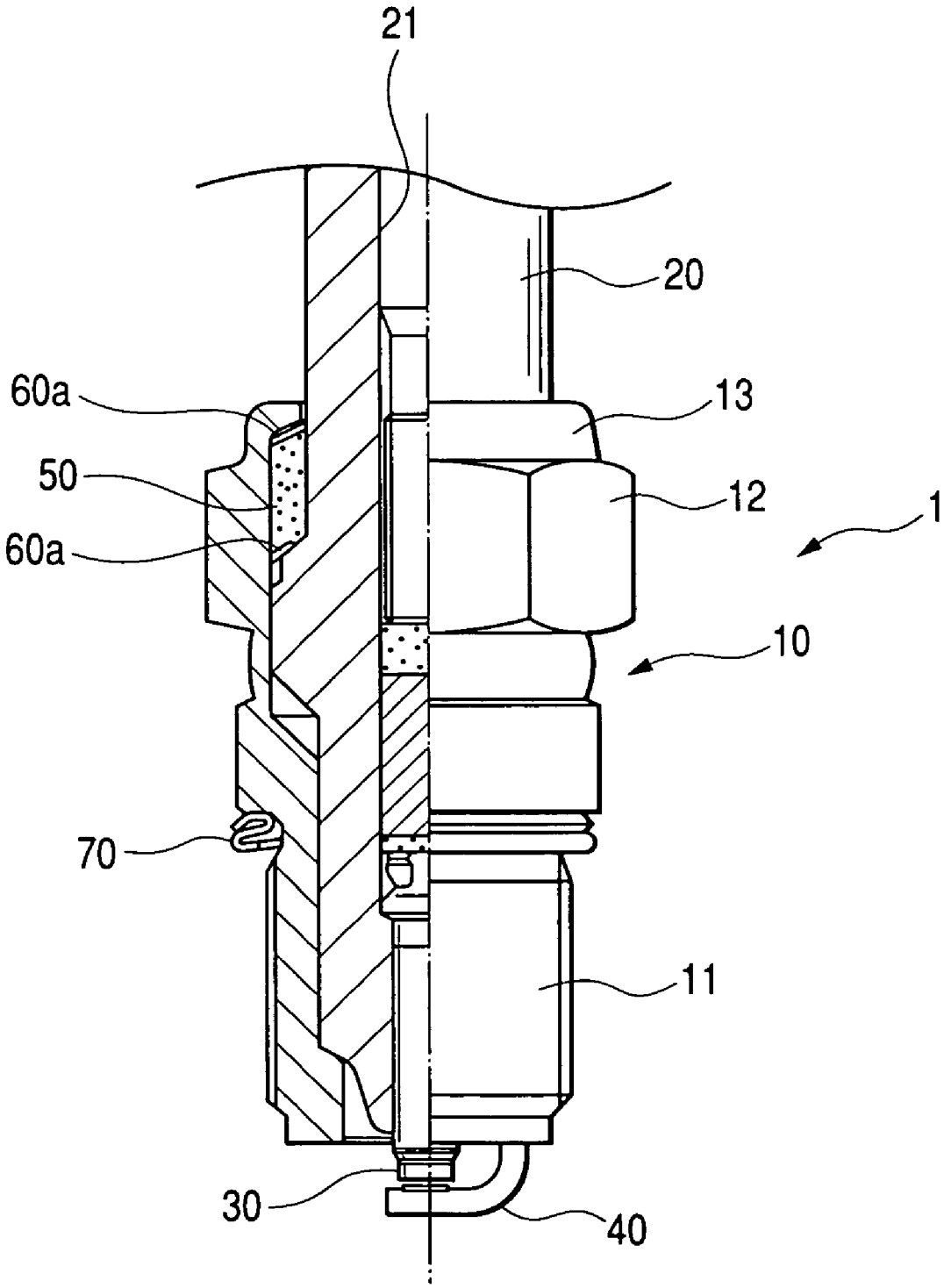

FIGS. 3, 4, and 5 are graphs which show the amount of gas leaking from the spark plug of FIG. 1 in terms of dimensions of a sleeve of a metal shell crimped to enhance the degree of air-tightness between the metal shell and an insulation porcelain; and FIG. 6 is a partially longitudinal sectional view of a spark plug according to the second embodiment of the invention.

DESCRIPTION OF THE PREFERRED EMBODIMENTS

Referring now to the drawings, particularly to FIG. 1, there is shown a spark plug 1 according to the first embodiment of the invention which is used in a cogeneration engine typically running at an average effective pressure of 1 MPa (approximately 10 kgf/cm$^2$) or more.

The spark plug 1 includes a hollow cylindrical metal housing or shell 10 made of a conductive steel, e.g., S25C low-carbon steel. The metal shell 10 has an external thread 11 having, for example, a metric screw size of M18 and a polygon head (e.g., hexagon head) 12 formed on an outer wall thereof.

The spark plug 1 is installed in a cylinder head (not shown) of the engine. Such installation is achieved by inserting the spark plug 1 into a plug hole (not shown) formed in the cylinder head, engaging a torque wrench with the polygon head 12, and turning the torque wrench to establish engagement of the external thread 11 of the metal shell 10 with an internal thread of the plug hole.

The metal shell 10 has installed therein a cylindrical insulation porcelain 20 made of a highly insulating ceramic such as alumina. The insulation porcelain 20 has formed therein a longitudinal hole 21 within which a cylindrical center electrode 30 is installed. The center electrode 30 consists of a core portion made of a metallic material such as Cu having a higher thermal conductivity and an external portion made of a metallic material such as an Ni-based alloy, a Fe-based alloy, or a Co-based alloy having higher thermal and corrosion resistances.

The metal shell 10 also has welded on an end thereof a ground electrode 40 which is made of an Ni-based alloy bar and bent to define an air gap (also called a spark gap) between itself and the tip of the center electrode 30.

The insulation porcelain 20 has a bulge 150 which is placed in abutment with an inner wall of the metal shell 10 to define an annular chamber 160 between a portion of the inner wall of the metal shell 10 opposed to the polygon head 12 and a portion of the outer wall of the insulation porcelain 20 above the bulge 150. The annular chamber 160 is filled with a sealing powder layer 50 made of talc. Rings 60 (e.g., O-rings) which are circular in transverse cross section are disposed within the annular chamber 160 at an interval away from each other in the longitudinal direction of the spark plug 1 in abutment with the inner wall of the metal shell 10.

The metal shell 10 also has an annular extension or sleeve 13 extending from an end of the polygon head 12. The sleeve 13 has an open end (i.e., an upper end, as viewed in FIG. 1) which is crimped or pressed inwardly to close the open end thereof and also to compress the sealing powder layer 50 downward, thereby urging the sealing powder layer 50 into firm abutment with the inner wall of the metal shell 10 and the outer wall of the insulation porcelain 20 to establish an air-tight seal between the metal shell 10 and the insulation porcelain 20.

A gasket 70 is fitted around the outer wall of the metal shell 10 to establish an air-tight seal between the metal shell 10 and the plug hole of the cylinder head of the engine.

We performed tests to evaluate a relation between the geometry or dimensions of the sleeve 13 and the degree of air-tight seal between the metal shell 10 and the insulation porcelain 20.

We prepared samples of the spark plug 1 in which the external thread 11 of the metal shell 10 had a metric screw size of M18, the inner diameter of a portion of the metal shell 10 defining the annular chamber 160 (i.e., the outer diameter of the annular chamber 160) was 17.5 mm, the outer diameter of a portion of the insulation porcelain 20 defining the annular chamber 160 (i.e., the inner diameter of the annular chamber 160) was 14.2 mm, and the length of the sleeve 13 in the longitudinal direction of the metal shell 10 before pressed inward was 5 mm.

Figure 2:
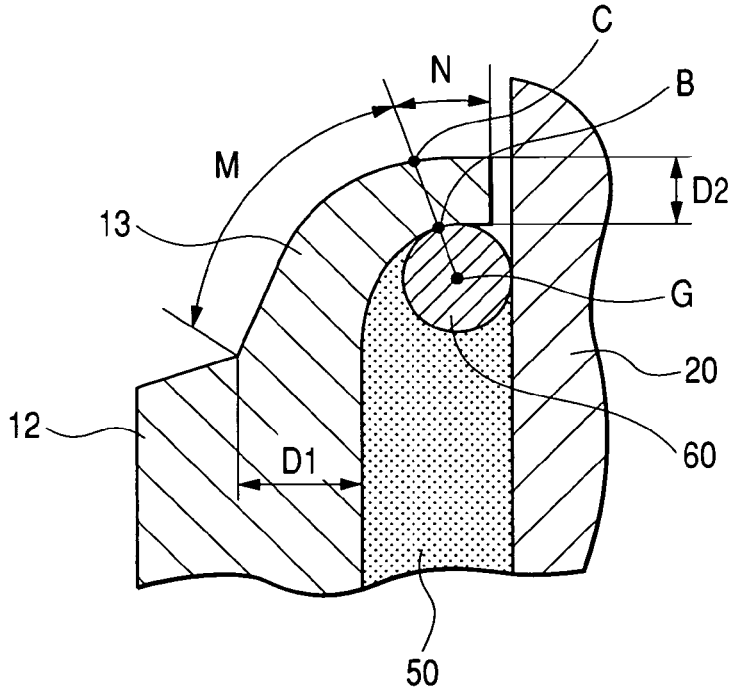
FIG. 2 is a partially enlarged sectional view of a portion, as indicated by an arrow A in FIG. 1, which shows a metal shell and an insulation porcelain of the spark plug, as illustrated in FIG. 1.

In the following discussion, the thickness of an interface of the sleeve 13 with the polygon head 12 in a radius direction of the metal shell 10, as clearly shown in FIG. 2, will be referred to as a base end thickness D1. The thickness of the open end of the sleeve 13 will be referred to as an open end thickness D2. Further, the center of gravity of an upper one of the rings 60, as viewed on a cross section extending in the longitudinal direction of the metal shell 10, will be referred to as a ring gravity center G. A portion of the outer wall of the ring 60 abutting with the inner wall of the sleeve 13 will be referred to as a contact B. An intersection of a line extending through the ring gravity center G and the contact B with the outer wall of the sleeve 13 will be referred to as a sleeve intersection C. The distance between the open end of the sleeve 13 and the sleeve intersection C along the profile of the outer wall of the sleeve 13 will be referred to as a sleeve top length N. The distance between the sleeve intersection C and the interface of the sleeve 13 with the polygon head 12 along the profile of the outer wall of the sleeve 13 will be referred to as a sleeve base length M.

The spark plug samples were prepared, as indicated by "X" in a graph of FIG. 3, which were different in the base end thickness D1 and the open end thickness D2. Specifically, values of the base end thickness D1 were 1.3 mm, 1.5 mm, 1.7 mm, 1.9 mm, and 2.1 mm. The spark plug samples having a base end thickness D1 of 1.3 mm included four types which were 8 mm 1.0 mm, 1.2 mm, and 1.3 mm in the open end thickness D2, respectively. The spark plug samples having a base end thickness D1 of 1.5 mm included five types which were 0.8 mm, 1.0 mm, 1.2 mm, 1.4 mm, and 1.5 mm in the open end thickness D2, respectively. The spark plug samples having either of base end thicknesses D1 of 1.7 mm, 1.9 mm, and 2.1 mm included five types which were 8 mm 1.0 mm, 1.2 mm, 1.4 mm, and 1.6 mm in the open end thickness D2, respectively Note that we prepared the four spark plug samples which were identical in the base end thickness D1 and the open end thickness D2 with each other.

We performed tests on the spark plug samples to evaluate the degree of air-tightness between the metal shell 10 and the insulation porcelain 20 in the following manner. Each of the spark plug samples was set on an air-tightness measurement machine with the center electrode 30 and the ground electrode 40 exposed to a hermetically closed chamber. The spark plug sample was fastened into a mount hole of the air-tightness measurement machine at a torque of 50 Nm. The temperature of the gasket 70 was 300° C. Gas (i.e., air) was supplied to the enclosed chamber of the air-tightness measurement machine at 2 Mpa (approximately 20 kgf/$cm^2$). The amount of the gas leaking outside the spark plug sample through a clearance between the metal shell 10 and the insulation porcelain 20 was measured.

Test results are shown in the graph of FIG. 3. The ordinate axis in FIG. 3 represents the amount of the gas leaking from the clearance between the metal shell 10 and the insulation porcelain 20. Each symbol "X" indicates one of the four spark plug samples having the same values of the base end thickness D1 and the open end thickness D2 which showed the greatest amount of leakage of the gas.

The graph shows that the amount of leakage is smaller when the open end thickness D2 is between 1.0 mm to 1.4 mm. We found that when the open end thickness D2 is less than 1.0 mm, it results in a lack of rigidity of the sleeve 13 after pressed inward, thus causing the sleeve 13 to be returned outward by the reaction of the sealing powder layer 50, which will result in a lack of compression of the sealing powder layer 50, while when the open end thickness D2 is more than 1.4 mm, it results in an undesirable increase in rigidity of the sleeve 13, which increases a difficulty in crimping or deforming the sleeve 13 into a desired shape in a direction in which the sealing powder layer 50 is compressed firmly.

The graph also shows that the amount of leakage is smaller when the base end thickness D1 is between 1.5 mm to 1.9 mm. We found that when the base end thickness D1 is less than 1.5 mm, it results in a lack of rigidity of the sleeve 13 after pressed inward, thus causing the sleeve 13 to be returned outward by the reaction of the sealing powder layer 50, which will result in a lack of compression of the sealing powder layer 50, and when the base end thickness D1 is more than 1.9 mm, it results in an undesirable increase in rigidity of the sleeve 13, which increases a difficulty in crimping or deforming the sleeve 13 into a desired shape in a direction in which the sealing powder layer 50 is compressed firmly.

Specifically, we confirmed experimentally that when the open end thickness D2 lies within a range of 1.0 mm to 1.4 mm, and the base end thickness D1 lies within a range of 1.5 mm to 1.9 mm, the amount of leakage of the gas is 1 cc/minute or less, which ensures a desired degree of air-tightness. Note that the amount of leakage less than 1 cc/minute is smaller than a limit required in typical cogeneration engines. It is, thus, appreciated that the spark plug 1 in which the open end thickness D2 is between 11.0 mm and 1.4 mm, and the base end thickness D1 is between 1.5 mm and 1.9 mm is suitable for cogeneration engines required to have a higher degree of the air-tightness.

We also prepared samples of the spark plug 1 which were different in the sleeve top length. N and the sleeve base length M. The spark plug samples were broken down into two types: the first in which the base end thickness D1 was 1.5 mm, and the open end thickness D2 was 1.0 mm and the second in which the base end thickness D1 was 1.9 mm, and the open end thickness D2 was 1.4 mm. The spark plug samples of each of the first and second types were 11.0 mm, 1.5 mm, 2.0 mm, 2.5 mm, and 3.0 mm in the sleeve top length N and 2.0 mm, 2.5 mm, 3.0 mm, 3.5 mm, and 4.0 mm in the sleeve base length M. Note that we prepared the spark plug samples, four in each value of the sleeve top length N and the sleeve base length M.

We performed tests on the spark plug samples to evaluate the degree of air-tightness between the metal shell 10 and the insulation porcelain 20 in the same manner as that in the former tests.

Test results are shown in graphs of FIGS. 4 and 5. The ordinate axis in each of FIGS. 4 and 5 represents the amount of the gas leaking from the clearance between the metal shell 10 and the insulation porcelain 20. Each symbol "X" indicates one of the four spark plug samples having the same values of the sleeve top length N and the sleeve base length M which showed the greatest amount of leakage of the gas.

The graphs of FIGS. 4 and 5 show that the amount of leakage is smaller when the sleeve top length N lies within a range of 1.5 mm to 2.5 mm. We found that when the sleeve top length N is less than 1.5 mm, it results in a difficulty in wrapping the ring 60 completely, thus resulting in a lack of compression of the sealing powder layer 50, while when the sleeve top length N is more than 2.5 mm, it causes the sleeve 13 to interfere physically with the insulation porcelain 20, thus resulting in a lack in compression of the sealing powder layer 50.

The graphs also show that the amount of leakage is smaller when the sleeve base length M is between 2.5 mm to 3.5 mm. We found that when the sleeve base length M is less than 2.5 mm, it results in an undesirable increase in rigidity of the sleeve 13, which increases a difficulty in crimping or deforming the sleeve 13 into a desired shape in a direction in which the sealing powder layer 50 is compressed firmly, and when the sleeve based length M is more than 3.5 mm, it results in a lack of rigidity of the sleeve 13 after pressed inward, thus causing the sleeve 13 to be returned outward by the reaction of the sealing powder layer 50, which will result in a lack of compression of the sealing powder layer 50.

Specifically, we confirmed experimentally that when the sleeve base length M lies within a range of 1.5 mm to 2.5 mm, and the sleeve top length N lies within a range of 2.5 mm to 3.5 mm, the amount of leakage of the gas is 1 cc/minute or less, which ensures a desired degree of air-tightness. Note that the amount of leakage less than 1 cc/minute is smaller than a limit required in typical cogeneration engines. It is, thus, appreciated that the spark plug 1 in which the sleeve top length N is between 1.5 mm and 2.5 mm, and the sleeve base length M is between 2.5 mm and 3.5 mm is suitable for cogeneration engines required to have a higher degree of the air-tightness.

FIG. 6 shows a spark plug 1 according to the second embodiment of the invention.

The spark plug 1 of this embodiment has flat rings 60*a* which are rectangular in transverse cross section. The flat rings 60*a* are made of a steel plate. Other arrangements are identical with those in the first embodiment, and explanation thereof in detail will be omitted here.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A spark plug for an internal combustion engine comprising:

a ground electrode;

a center electrode defining a spark gap between itself and said ground electrode;

an insulation porcelain having said center electrode retained therein;

a cylindrical metal housing within which said insulation porcelain is disposed, said metal housing defining an annular chamber between an inner wall of said metal housing and an outer wall of said insulation porcelain;

a polygonal portion formed on an outer wall of said metal housing around the annular chamber;

a powder layer filled within the annular chamber to establish a hermetic seal between said metal housing and said insulation porcelain; and an annular extension formed on said metal housing which extends from an end of said polygonal portion to have an open end opposite an end thereof continuing from said polygonal portion, the open end being crimped inward of said metal housing to retain the powder layer within the annular chamber firmly, the open end having a thickness of 1.0 mm to 1.4 mm.

2. A spark plug as set forth in claim 1, wherein the end of said annular extension interfacing said polygonal portion formed on said metal housing has a thickness of 1.5 mm to 1.9 mm in a radius direction of said metal housing.

3. A spark plug as set forth in claim 1, further comprising a ring which is disposed within the annular chamber in abutment with an inner wall of said annular extension, and wherein said metal housing has a length extending in a direction in which said polygonal portion and said annular extension are aligned, and if the center of gravity of a cross section of said ring, as taken in a lengthwise direction of said metal housing, is defined as a ring gravity center G, a contact between said ring and the inner wall of said annular extension is defined as a ring-to-extension contact B, an intersection of a line extending through the ring gravity center G and the ring-to-extension contact B with the outer wall of said annular extension is defined as an extension intersection C, and a distance between the open end of said annular extension and the extension intersection C along the outer wall of said annular extension is defined as an extension top length N, the extension top length N lies within a range of 1.5 mm to 2.5 mm.

4. A spark plug as set forth in claim 1, further comprising a ring which is disposed within the annular chamber in abutment with an inner wall of said annular extension, and wherein said metal housing has a length extending in a direction in which said polygon portion and said annular extension are aligned, and if the center of gravity of a cross section of said ring, as taken in a lengthwise direction of said metal housing, is defined as a ring gravity center G, a contact between said ring and the inner wall of said annular extension is defined as a ring-to-extension contact B, an intersection of a line extending through the ring gravity center G and the ring-to-extension contact B with the outer wall of said annular extension is defined as an extension intersection C, and a distance between the end of said annular extension interfacing the polygon portion and the extension intersection C along the outer wall of said annular extension is defined as an extension base length M, the extension base length M lies within a range of 2.5 mm to 3.5 mm.

5. A spark plug as set forth in claim 1, wherein said metal housing has an external thread which establishes engagement with an internal thread formed in an internal combustion engine, said external thread having a metric screw size of M18.

6. A spark plug as set forth in claim 1, wherein the spark plug is used in an internal combustion engine which is to be operated at an average effective pressure of 1 MPa or more.

7. A spark plug for an internal combustion engine comprising:

a ground electrode;

a center electrode defining a spark gap between itself and said ground electrode;

an insulation porcelain having said center electrode retained therein;

a cylindrical metal housing within which said insulation porcelain is disposed, said metal housing defining an annular chamber between an inner wall of said metal housing and an outer wall of said insulation porcelain;

a polygon portion formed on an outer wall of said metal housing around the annular chamber;

a powder layer filled within the annular chamber to establish a hermetic seal between said metal housing and said insulation porcelain;

an annular extension formed on said metal housing which extends from an end of said polygon portion to have an open end opposite an end thereof continuing from said polygon portion, the open end being crimped inward of said metal housing to retain the powder layer within the annular chamber firmly; and a ring disposed within the annular chamber in abutment with an inner wall of said annular extension, wherein said metal housing has a length extending in a direction in which said polygon portion and said annular extension are aligned, the open end of said annular extension has a thickness of 1.0 mm to 1.4 mm, and the end of said annular extension interfacing said polygon portion has a thickness of 1.5 mm to 1.9 mm in a radius direction of said metal housing, and wherein if the center of gravity of a cross section of said ring, as taken in a lengthwise direction of said metal housing, is defined as a ring gravity center G, a contact between said ring and the inner wall of said annular extension is defined as a ring-to-extension contact B, an intersection of a line extending through the ring gravity center G and the ring-to-extension contact B with the outer wall of said annular extension is defined as an extension intersection C, a distance between the open end of said annular extension and the extension intersection C along the outer wall of said annular extension is defined as an extension top length N, and a distance between the end of said annular extension interfacing the polygon portion and the extension intersection C along the outer wall of said annular extension is defined as an extension base length M, the extension top length N lies within a range of 1.5 mm to 2.5 mm, and the extension base length M lies within a range of 2.5 mm to 3.5 mm.

* * * * *